United States Patent [19]

Lingl, Jr.

[11] Patent Number: 4,722,682

[45] Date of Patent: Feb. 2, 1988

[54] METHOD AND APPARATUS FOR COOLING THE UNDERSIDE OF A TRAIN OF KILN CARS IN A TUNNEL KILN

[75] Inventor: Hans Lingl, Jr., Neu-Ulm, Fed. Rep. of Germany

[73] Assignee: Lingl Corporation, Paris, Tenn.

[21] Appl. No.: 930,924

[22] Filed: Nov. 17, 1986

[30] Foreign Application Priority Data

Nov. 19, 1985 [DE] Fed. Rep. of Germany ..... 3541015

[51] Int. Cl.[4] ..... F27B 9/26; F27D 3/12

[52] U.S. Cl. ..... 432/137; 432/241; 432/77

[58] Field of Search ..... 432/133–137, 432/141, 144, 233, 238, 241, 77

[56] References Cited

U.S. PATENT DOCUMENTS

| | | | |
|---|---|---|---|
| 1,965,832 | 7/1934 | Hartford et al. | 432/137 |
| 2,191,438 | 2/1940 | Breeler | 432/137 |
| 4,069,010 | 1/1978 | Fay | 432/137 |
| 4,375,354 | 3/1983 | Henriksson | 432/241 |
| 4,421,481 | 12/1983 | Holz et al. | 432/137 |
| 4,482,314 | 11/1984 | Griese et al. | 432/137 |
| 4,504,221 | 3/1985 | Hartmann | 432/241 |
| 4,560,350 | 12/1985 | Doby | 432/137 |

FOREIGN PATENT DOCUMENTS 0086693 8/1924 European Pat. Off. .

OTHER PUBLICATIONS

Lingl Leaflet FO45/3, Jul. 1982.

*Primary Examiner*—Henry C. Yuen

*Attorney, Agent, or Firm*—Nixon & Vandehye

[57] ABSTRACT

Transverse sub-chambers are defined beneath a train of kiln cars. Pressure equalization is permitted with respect to the firing chamber thereabove but very little air will actually pass therebetween because there is no other substantial air passageway leading into or out of the sub-chamber. Rather, heat exchange cooling apparatus is employed in each sub-chamber so as to set up convention air currents within the sub-chamber to cool the underside of the kiln car. The heat exchanger units in different sub-chambers are preferably individually controllable so as to provide a controllable degree of undercar cooling as a function of location along the tunnel kiln.

18 Claims, 2 Drawing Figures

Figure 1:
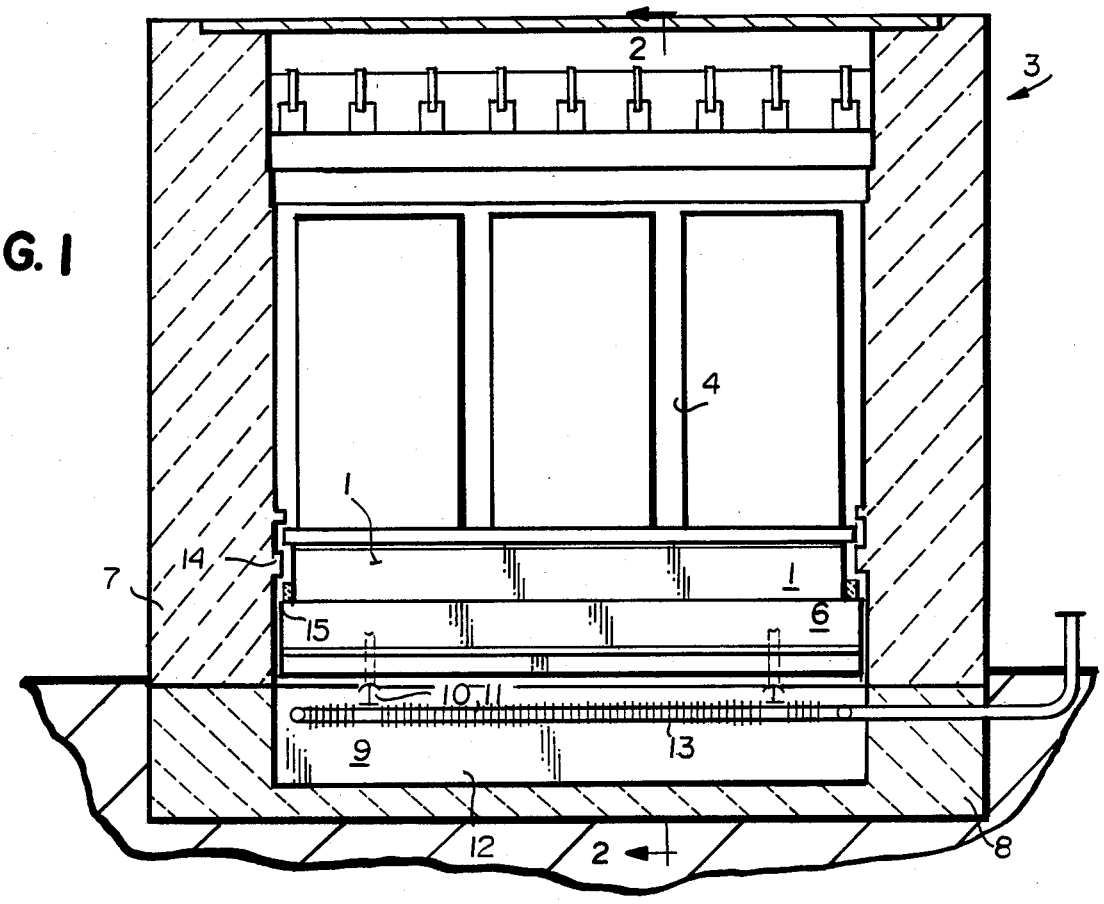

METHOD AND APPARATUS FOR COOLING THE UNDERSIDE OF A TRAIN OF KILN CARS IN A TUNNEL KILN

This invention is generally directed to method and apparatus for cooling the underside of a train of kiln cars located in a tunnel kiln. It includes specially adapted kiln cars as well as an especially adapted tunnel kiln and the system comprising such specially adapted kiln cars and kiln.

For various reasons, it is often necessary to insure that the underside of a kiln car is maintained in a relatively cooler atmosphere than the upper deck side (on which uncured ceramic materials are typically carried for firing in the kiln). For example, it may be necessary to achieve sufficient cooling to avoid overheating of mechanisms such as kiln car wheels or the like located beneath the deck of a kiln car.

In general, the foundation and lower side walls of the tunnel kiln may be cooled in an attempt to dissipate heat flowing through the deck of kiln cars to avoid such overheating. One typical prior art practice is to attempt cooling of the undercar channel by means of air drawn through the undercar channel from the exit end of the tunnel kiln toward its entrance end. The firing channel of the tunnel kiln is typically also flushed with gases flowing the same direction so that a pressure gradient develops in both channels (i.e., the firing channel located above the car decks and the undercar channel located therebelow) from the exit towards the entrance end of the tunnel.

However, because there are different gas flow resistances in the two different channels, the pressure gradient is different as a function of distance along the tunnel thereby leading to "leakage" air flows between the two channels. Such air flows between the two channels is a situation which must be avoided by appropriate measures so as to avoid undue heating of the undercar channel (or undue cooling of the firing channel).

It will be understood that the sides of kiln cars typically travel in close proximity to the tunnel side walls. One conventional method for sealing the moving kiln car sides to the kiln side walls is to provide aprons along the longitudinal car sides which dip into sand-filled channels in skirting of the kiln side walls such that the sand forms a closed barrier extending the length of the kiln. Transverse joints between successive kiln cars may be sealed by means of conventional elastic material cords (e.g., see Lingl Leaflet F045/3 dated July 1982).

Although the purpose of such prior sand barriers is to substantially prevent pressure equalization between the undercar channel and the firing channel, it is far from a perfect seal. In the first place, for design and cost reasons, the depth to which such aprons dip into the sand must be comparatively small. In addition, the sand must be made comparatively course so that it will be heavy enough not be blown out of the barrier area and entrained in a moving gas flows. As a result, the sand barrier actually is permeable to gas and provides a far from perfect seal.

Another prior approach (EP-OS No. 0, 086,693) uses a kiln car including a box-like structure open at the bottom and provided with sheet metal aprons extending all about the car. At the entrance to the tunnel kiln, each car is lowered into a running fluid bath which provides a continuous hydraulic seal below the car train. The fluid is circulated under the cars for cooling purposes.

However, in addition to requiring lowering and lifting devices for each kiln car at the entrance and exit of the tunnel kiln, the cooling fluid is entrained in one large continuous container so that it is not possible to control the degree of cooling as a function of position along the tunnel kiln. For example, heat is undesirably removed even in the initial heat-up zone of the tunnel kiln where undercar cooling is neither necessary nor desirable (e.g., because it ultimately removes heat from the firing channel which, at this point, is contrary to the desired purpose of getting the top-side of the car and material carried thereon up to kiln curing temperatures as fast as possible).

I have now discovered a novel method and apparatus for undercar cooling of kiln cars in a tunnel kiln which permits the heat exchange or cooling performance to be varied both locally and in degree while minimizing the entrance of "leakage" air into the firing channel and also conveniently enabling transferred heat energy to be recovered for other useful purposes if desired.

In general, a tunnel kiln is provided with plural sub-chambers disposed therealong beneath the intended track of a train of kiln cars. Gas flows to and from each of the sub-chambers are substantially isolated and prevented *except* for that required to equalize pressure between the sub-chamber and the section of the firing channel located directly thereabove. A heat exchanger provides cooling within the sub-chamber thus setting up convection currents within the sub-chamber which tend to cool the underside of the kiln car located directly thereabove. However, since there is no substantial gas flow into or out of the sub-chamber, there is no substantial "leakage" gas flow between the cooling channel and the firing channel.

Furthermore, since the heat exchanger located in each isolated sub-channel may be individually controlled, the degree of cooling heat exchange provided within each of the sub-chambers may be varied as a function of position along the tunnel kiln. In other words, at the entrance end, very little or no heat exchange may be provided whereas after the kiln cars have reached operating temperature, an increased degree of heat exchange may be employed so as to maintain the underside of the kiln cars below some predetermined maximum temperature. In fact, automatic feedback control systems may be employed if desired to automatically control each of the individual heat exchange units so as to maintain the underside of each kiln car at or below some predetermined maximum temperature at every point along the tunnel kiln.

Preferably, a radiation blocking structure is employed in the pressure equalization passage located between the cooling channel and the firing channel so as to prevent direct radiation transfers of heat energy from the firing channel into the cooling channel.

The advantages of this invention can be achieved, at least in part, because the pressure gradient between the firing channel and the undercar cooling channel is greatly reduced. Therefore, "leakage" air flows between these two channels is minimized. Such leakage air flows are minimized, at least in part, because the undercar cooling channel is divided transversely into sub-chambers or sections which can be individually and differently cooled. Preferably, the cooling devices are heat exchangers so that the extracted heat energy may be recovered and used for other desirable purposes.

Transverse structures associated with the undercar channel of the tunnel kiln and/or with the undercarriage of the kiln cars is located at predetermined intervals. As a result, when these transverse structures are properly situated, the undercar area is effectively divided and sealed into sub-channels or sections. This not only avoids substantial pressure gradient in the longitudinal direction of any given sub channel, it also avoids substantial pressure gradients between individual sub-chambers of the undercar cooling channel and the portion of a firing channel located thereabove (indeed, pressure equalization is encouraged between each sub-chamber and the section of firing channel located thereabove).

As a result, sand-filled channels or other types of attempted seals between the firing channel and the undercar cooling channel are no longer required. And, as an added advantage, the undercar channel can be cooled at different rates in different sections or sub-chambers as a function of position along the tunnel kiln. Furthermore, the kiln cars can continue to be transported along a rail system in the same plane both inside and outside the tunnel kiln so that lifting or lowering devices are avoided. This greatly facilitates movement and circulation of the kiln cars with conventional apparatus and existing facilities which can be retrofitted or converted after the fact to practice the present invention.

Figure 2:
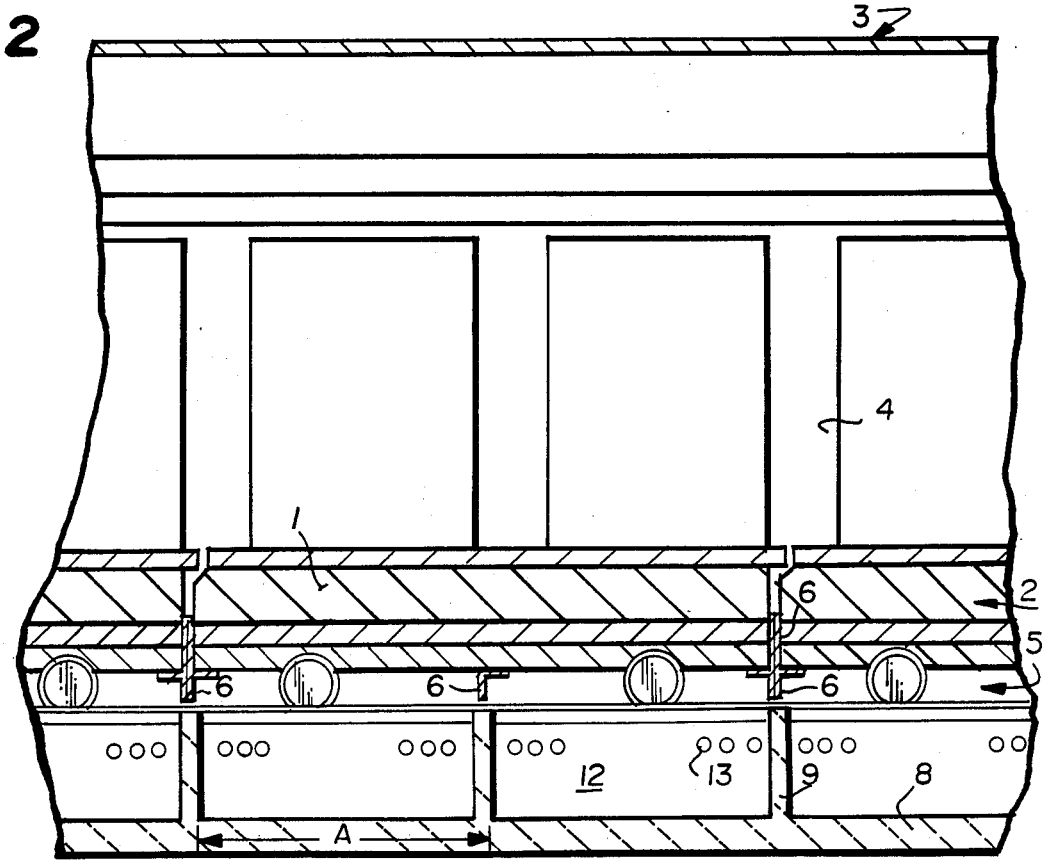

These as well as other objects and advantages of this invention will be more completely understood and appreciated by carefully studying the following detailed description of a presently preferred exemplary embodiment taken in conjunction with the drawings, of which:

FIG. 1 is a schematic cross-sectional view through a tunnel kiln modified so as to practice this invention; and FIG. 2 is a schematic longitudinal section through the tunnel kiln of FIG. 1 illustrating a train of kiln cars in a kiln system adapted to practice this invention.

Referring to the drawings, a kiln car train 2 includes a plurality of closely spaced rail-mounted kiln cars 1 which is typically pushed through a tunnel kiln 3. The deck of the kiln cars passes in close adjacency to the lower side walls of the tunnel kiln thus "closing" the bottom of a firing channel 4 and separating it from an undercar cooling channel 5. In the exemplary embodiment, the end of each kiln car 1 is provided with an apron 6 (e.g., made of ordinary steel plate) which depends downwardly toward the rails 10. If desired, an additional apron 6 may be disposed at other predetermined locations such as depicted at FIG. 2 at the middle of each kiln car. The aprons 6 are disposed with little (e.g., 10 millimeters or less) if any clearance with respect to the kiln walls 7 so that they act as seals. A projecting course 15 of soft insulating refractory material is disposed along the side of each kiln car 1 so as to pass with very little clearance from a projecting course 14 located on the kiln wall 7. This interdigitated structure of refractory material serves as a radiation barrier so as to prevent the transfer of heat energy by direct radiation from the firing chamber 4 to the cooling chamber 5.

The kiln foundation 8 may be thought of as a form of trough having transverse partitions 9 spaced apart by a distance A which corresponds to the distance between aprons 6 (or a multiple thereof). As will be understood in a typical "intermittent" kiln, the train of kiln cars is intermittently advanced by a predetermined increment of distance (e.g., distance A).

The transverse partitions 9 extend upwardly to the level of the track rail tops so that the clearance between the bottom of aprons 6 and the top of partitions 9 is nonexistent or only very small (e.g., 10 millimeters or less) so as to effectively result in a "tight" seal preventing substantial gas flows therethrough.

The kiln car rails 10 are supported by means of conventional beams 11 to bridge the sub-chambers 12 formed by this type of structure. Directly below the beams 11 are heat exchanger cooling pipes 13 disposed so as to set up a natural circulation of air by convection currents within each of the sub-chambers 12. By controlling the passage of coolant fluid within heat exchange pipes 13, the intensity of such convection air currents can be controlled in sections corresponding to the length of each sub-chamber or multiples thereof.

Since there is no attempt to make a gas tight seal vertically between firing chamber 4 and cooling chamber 5 along the sides of the tunnel kiln, pressure equalization can freely take place between the firing channel 4 and the undercar channel 5. However, since there is otherwise no significant air supplied to or removed from the undercar channel 5 (nor any of the effectively isolated sub-chambers 12), there is no significant "leakage" air flow. In other words, the very small gap that may still exist between aprons 6, partitions 9 and kiln wall 7, does not permit any significant longitudinal gas flow along the undercar channel 5.

In short, this invention provides method and apparatus for undercar cooling of kiln cars in a tunnel kiln and for substantially preventing "leakage" air flows between the firing channel and the undercar cooling channel *even though* pressure equalization flows are freely permitted between the firing channel and each individual isolated sub-chamber of the undercar channel. In particular, the undercar channel is divided into sections with transverse partitions (with respect to the longitudinal axis of the tunnel kiln), with each sub-chamber being provided with an individually controllable cooling device so that air cooling convection currents can be developed within each sub-chamber below the kiln cars. The intensity and thus cooling effect within each sub-chamber may thus be adjusted and controlled separately.

While only one exemplary embodiment of this invention has been described in detail, those skilled in the art will recognize that many modifications and variations may be made in this embodiment while yet retaining many of the novel features and advantages of this invention. All such modifications and variations are intended to be included within the scope of the appended claims.

What is claimed is:

1. A system for cooling the underside of kiln cars located in a tunnel kiln, said system comprising:

a plurality of kiln cars;

a tunnel kiln including elongated bottom, side and top structures defining an elongated tunnel;

said kiln cars including (1) a deck portion on which uncured articles may be stacked for kiln curing, and (2) undercarriage means for supporting said deck portion in spaced relation to said bottom of said tunnel kiln and for facilitating the passage of said kiln cars through said elongated tunnel in train formation such that said deck portion passes in close proximity to said side structures so as to define thereabove an upper kiln tunnel channel and to define therebelow a lower tunnel chamber in which said undercarriage means is positioned, said lower tunnel chamber subdivided transversely into plural cooling sub-chambers by transversely situated dividers disposed on said kiln cars and/or on the bottom of the tunnel kiln; and cooling means disposed in each of at least some of said cooling sub-chambers for cooling said undercarriage means.

2. A system as in claim 1 wherein the cooling means in each sub-chamber having such cooling means is separately controllable.

3. A system as in claim 1 wherein each said cooling means comprises a heat exchanger having a cooling liquid circuit therethrough and air contact fins therealong for setting up convection cooling currents of air within its respective said sub-chamber.

4. A system as in claim 1 wherein a gas flow path extends from the upper kiln firing tunnel downwardly past the side structures and kiln car decks to/from each of said sub-chambers so as to provide pressure equalization therebetween.

5. A system as in claim 4 wherein each said sub-chamber is substantially sealed off from gas transfers thereto and therefrom except for pressure equalization flows to/from the portion of said upper chamber located thereabove.

6. A system as in claim 1 wherein said transversely situated dividers comprise:

transverse aprons depending downwardly from said kiln cars at predetermined intervals.

7. a system as in claim 1 wherein said transversely situated dividers comprise:

transverse partitions extending upwardly at predetermined intervals from the bottom of said tunnel kiln.

8. A system as in claim 1 wherein said transversely situated dividers comprise:

transverse aprons depending downwardly from said kiln cars at predetermined intervals; and transverse partitions extending upwardly at said predetermined intervals from the bottom of said tunnel kiln.

9. A tunnel kiln adapted for controlled undercar cooling and including elongated bottom, side and top structures through which kiln cars may be passed in train formation, said kiln comprising:

a plurality of transverse sub-chambers formed into said bottom structure;

means for supporting an undercarriage of said kiln cars above said transverse subchambers when said kiln cars pass through said tunnel kiln; and heat exchange means disposed in each of at least some of said sub-chambers for cooling said undercarriages of said kiln cars which pass thereabove.

10. A tunnel kiln as in claim 9 wherein said sub-chambers comprise transverse partitions extending upwardly at predetermined intervals from the bottom of said tunnel kiln.

11. A method of undercar cooling for kiln cars in a tunnel kiln with the aid of air characterized by:

effecting pressure equalization between (a) an undercar channel formed by the foundation, the side walls of the tunnel kiln and the lower parts of the kiln cars and (b) a firing channel formed above the kiln cars, said undercar channel being divided into sections transversely to the longitudinal axis of the tunnel kiln and the direction in which the cars are advanced, and producing a convection air current cooling the undersides of the kiln cars in said sections, the intensity, and thus cooling effect, of which is separately adjustable in each section by controlling a cooling device located therein.

12. A tunnel kiln system with kiln cars which can be passed through the kiln in train formation to practice the method of claim 11 and including a firing channel formed by the kiln cars travelling in close proximity to the side walls of the tunnel above the kiln cars, an undercar channel below the kiln cars and aprons disposed on the kiln cars which project toward the foundation, said system being characterized in that:

the aprons (6) are disposed at the end of at least one of the successive kiln cars (1) in sliding contact with the kiln walls (7) and projecting down toward and touching, or almost touching, the foundation (8) of the kiln (3) and having the sections of the undercar channel formed at intervals corresponding to the length of one kiln car with cooling pipes (13) serving as cooling devices disposed in the area of the foundation (8).

13. A tunnel kiln system as claimed in claim 12, characterized in that the foundation takes the form of a trough divided into a plurality of individual troughs by means of partitions (9) disposed at intervals (A) corresponding to the car separation or a multiple of the car separation of an intermittent kiln, with cooling pipes disposed in each of the individual troughs whose cooling air supply can be controlled separately for each individual trough.

14. A tunnel kiln system as claimed in claim 12 or 13 including a pair of rails on which the kiln cars are carried and characterized in that the partitions (9) extend up to rail top level and that the clearance between the aprons (6) and the partitions (9) is no more than about 10 millimeters.

15. A tunnel kiln system as claimed in claims 12 or 13, characterized in that a radiation barrier (14, 15) permitting pressure equalization to take place between the firing channel (4) and the undercar channel (5) is provided between the longitudinal sides of the kiln cars (1) and the kiln walls (7).

16. A tunnel kiln system as claimed in claim 15, characterized in that the said radiation barrier comprises at least one projecting course (15) of insulating refractories on the longitudinal sides of the kiln cars (1) and at least one other such projecting course (14) on the kiln walls (7) disposed with little clearance between the two projecting courses (14, 15).

17. A method for cooling the underside of a train formation kiln cars located in a tunnel kiln, said method comprising the steps of:

establishing transverse divisions of a channel space located beneath said train of kiln cars so as to define plural sub-chambers therealong;

substantially isolating gas flows to/from each of said sub-chambers except that required for pressure equalization with a corresponding section of an upper channel space located above said train of kiln cars in which kiln curing of articles carried by said cars is occurring; and controllably extracting heat from predetermined sub-chambers to effect cooling of the underside of said kiln cars.

18. A tunnel kiln system comprising:

a tunnel kiln having plural sub-chambers disposed therealong below a train of kiln cars;

means for substantially isolating gas flows to/from each of said sub-chambers except that required for pressure equalization with a corresponding section of an upper channel space located above said train of kiln cars; and cooling means disposed in each of at least some of said sub-chambers for controllably extracting heat from such sub-chambers to effect cooling of the underside of said kiln cars.

* * * * *